US009089218B2

(12) United States Patent
Pelletier et al.

(10) Patent No.: US 9,089,218 B2
(45) Date of Patent: Jul. 28, 2015

(54) GLIDING MECHANISM FOR A GLIDING RECLINER SEATING ASSEMBLY

(71) Applicants: Patrice Pelletier, Sainte-Mélanie (CA); Pelletier Gino, Sainte-Mélanie (CA)

(72) Inventors: Patrice Pelletier, Sainte-Mélanie (CA); Pelletier Gino, Sainte-Mélanie (CA)

(73) Assignee: PEL INTERNATIONAL INC., St-Felix-de-Valois (CA)

( * ) Notice: Subject to any disclaimer, the term of this patent is extended or adjusted under 35 U.S.C. 154(b) by 204 days.

(21) Appl. No.: 13/956,722

(22) Filed: Aug. 1, 2013

(65) Prior Publication Data

US 2014/0049086 A1 Feb. 20, 2014

Related U.S. Application Data

(60) Provisional application No. 61/742,561, filed on Aug. 14, 2012.

(51) Int. Cl.

| | |
|---|---|
| ***A47C 3/02*** | (2006.01) |
| ***A47C 1/0355*** | (2013.01) |
| ***A47C 1/034*** | (2006.01) |

(52) U.S. Cl.

CPC ..... *A47C 1/0355* (2013.01); *A47C 1/0345* (2013.01)

(58) Field of Classification Search

CPC ... A47C 1/0355; A47C 1/0345; A47D 13/105

USPC ..... 297/259.3, 259.2, 344.21

See application file for complete search history.

(56) References Cited

U.S. PATENT DOCUMENTS

| | | | | |
|---|---|---|---|---|
| 4,544,201 | A * | 10/1985 | Rogers, Jr. | 297/259.2 |
| 5,765,913 | A * | 6/1998 | LaPointe et al. | 297/281 |
| 5,795,021 | A * | 8/1998 | Rogers | 297/281 |
| 5,931,530 | A * | 8/1999 | Liu | 297/270.3 |
| 2007/0063559 | A1 * | 3/2007 | Chouinard et al. | 297/281 |

* cited by examiner

*Primary Examiner* — Milton Nelson, Jr.

(74) *Attorney, Agent, or Firm* — BCF LLP

(57) ABSTRACT

A gliding mechanism for a gliding recliner seating assembly comprises a floor-standing base having a longitudinal cross member parallel to a width of the seating assembly. Two front connecting links and two back connecting links respectively connect, pivotally, front and back portions of the seating assembly to the floor-standing base. The longitudinal cross member supports a weight transferred by the seating assembly to the floor-standing base and is positioned closer to the back portion of the seating assembly than to the front portion of the seating assembly. The gliding mechanism can be made part of a gliding recliner chair, for example an armchair, having vertical side frames pivotally connected to the floor-standing base. A footrest can be added to the seating assembly and be operated in extended position without preventing gliding movement of the chair. The floor-standing base may comprise a pivoting portion allowing rotation of the chair.

20 Claims, 17 Drawing Sheets

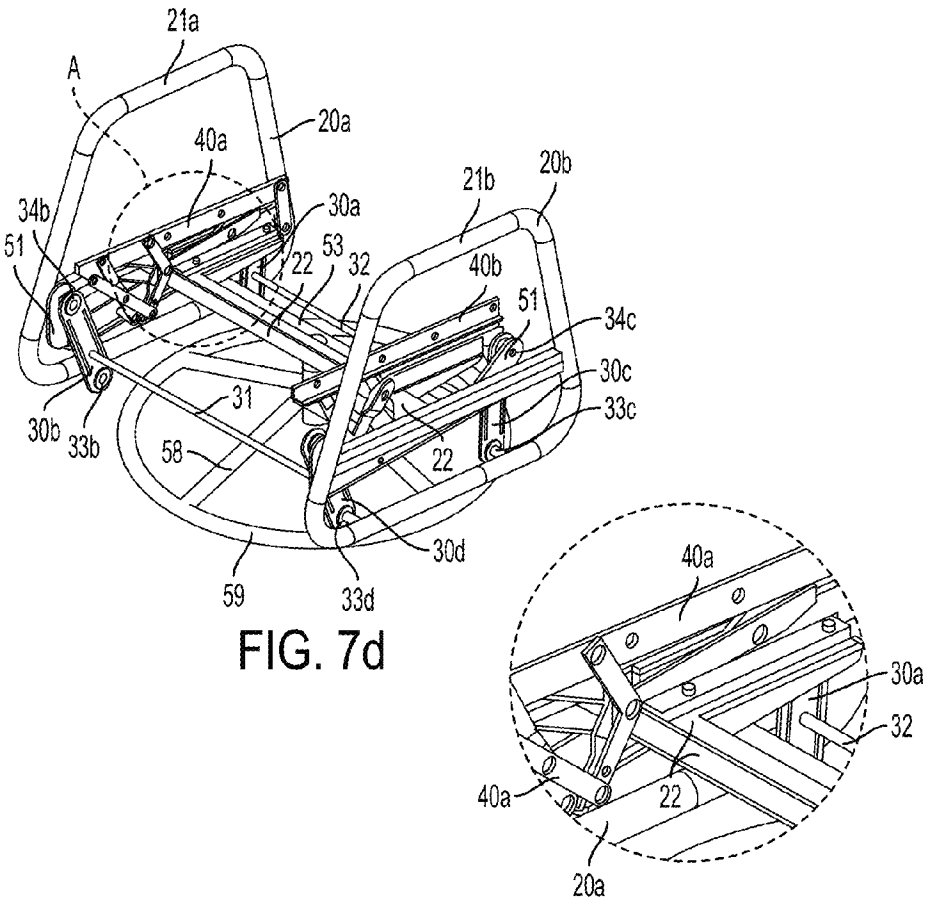
FIG. 7d
FIG. 7e
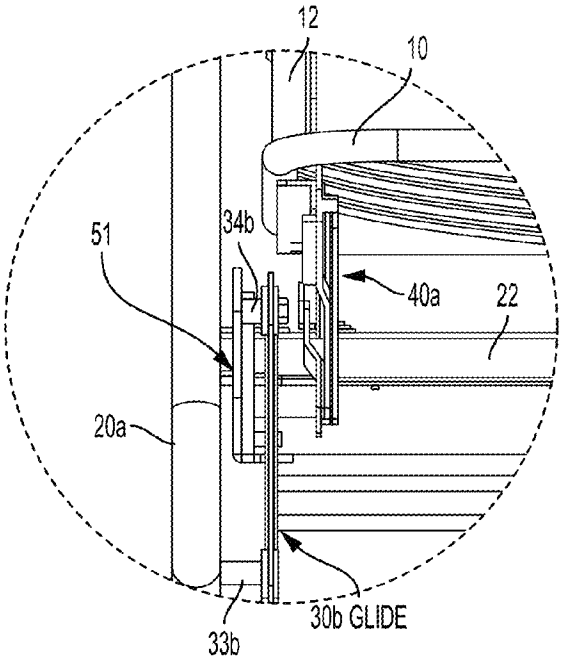
FIG. 7c

GLIDING MECHANISM FOR A GLIDING RECLINER SEATING ASSEMBLY

TECHNICAL FIELD

The present disclosure relates to glider chairs, and more particularly contemplates a gliding mechanism for a gliding recliner seating assembly.

BACKGROUND

Gliding chairs, including armchairs, have been in use for several years. For example, some armchairs are provided with a system that enables synchronized backrest reclining and footrest extension. There are also a few known pieces of furniture integrating a gliding motion and a backrest reclining/footrest extension system. Special devices such as pantographic actuators manufactured by LEGGETT & PLATT®, Incorporated (Carthage, Mo.) are specifically engineered to enable the synchronized motions of backrest reclining and footrest extension. However, mounting pantographic actuators on a glider armchair is challenging if one wishes to preserve safe and user friendly operation. Therefore, no currently available chair allows the gliding action to take place while the backrest is operated in the reclined position and/or when a footrest is operated in the extended (usable) position. When installed on gliding chair, a locking device usually locks the seat in a predetermined position and prevents gliding when the backrest/footrest system is in the extended position so as to avoid accidents.

However, it would represent a significant advance in the art if a glider armchair user could pursue the gliding action with a reclined backrest and/or an extended footrest. There is thus a need for a novel gliding mechanism for a gliding recliner seating assembly offering gliding capability and concurrent backrest reclining and/or footrest deployment (extension) functions.

SUMMARY

According to a first aspect, the present disclosure provides a gliding mechanism for a gliding recliner seating assembly. The gliding mechanism comprises a floor-standing base having a longitudinal cross member parallel to a width of the seating assembly, and two front connecting links and two back connecting links for, respectively, pivotally connecting front and back portions of the seating assembly to the floor-standing base. The longitudinal cross member supports a weight transferred by the seating assembly to the floor-standing base and is positioned closer to the back portion of the seating assembly than to the front portion of the seating assembly.

According to a second aspect, the present disclosure provides a gliding recliner chair. The gliding recliner chair comprises a seating assembly and the aforementioned gliding mechanism. The seating assembly includes a backrest, left and right vertical side frames, and a seat extending between the left and right vertical side frames. The left and right vertical side frames are pivotally connected to the floor-standing base through the front and back connecting links.

According to a third aspect, the gliding recliner chair comprises a footrest operable between a retracted position and an extended position. Gliding movement of the seating assembly with respect to the floor-standing base is enabled when the backrest and the footrest adopt any of the retracted position or extended position.

According to a fourth aspect, the floor-standing base comprises a floor-engaging portion defining a floor-engaging planar perimeter having a longitudinal dimension in the direction of a gliding movement of the seating assembly. A normal projection of a center of gravity of a weight supported by the longitudinal cross member lies within the planar perimeter, generally spaced from the perimeter by a distance of at least about 15% of the longitudinal dimension, at any position of the gliding movement and at any position of the backrest and footrest.

According to a fifth aspect, the weight transferred by the seating assembly to the floor-standing base comprises a weight of the seating assembly alone or a combined weight of the seating assembly and of a user sitting on the seating assembly.

According to a sixth aspect, a center of a path followed by the center of gravity during a gliding movement with the backrest and footrest in the extended position is substantially in alignment with a vertical axis of the floor-standing base, the vertical axis being aligned with a center of the planar perimeter.

According to a seventh aspect, the floor-standing base further comprises a pivoting portion connected to the floor-engaging portion by a pivot, allowing a circular rotation about a vertical axis of the pivoting portion with respect to the floor-engaging portion. The vertical axis is aligned with a center of the floor-engaging planar perimeter. The connecting links are supported by the pivoting portion.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which:

FIGS. 7*a* to 7*e* show different views of the gliding recliner armchair of FIGS. 1*a* and 1*b* with backrest and footrest in a fully retracted position: (a) left side view, (b) front elevation view, (c) detail of front view, (d) partial isometric view and (e) detail from partial isometric view;

DETAILED DESCRIPTION

Figure 1A:
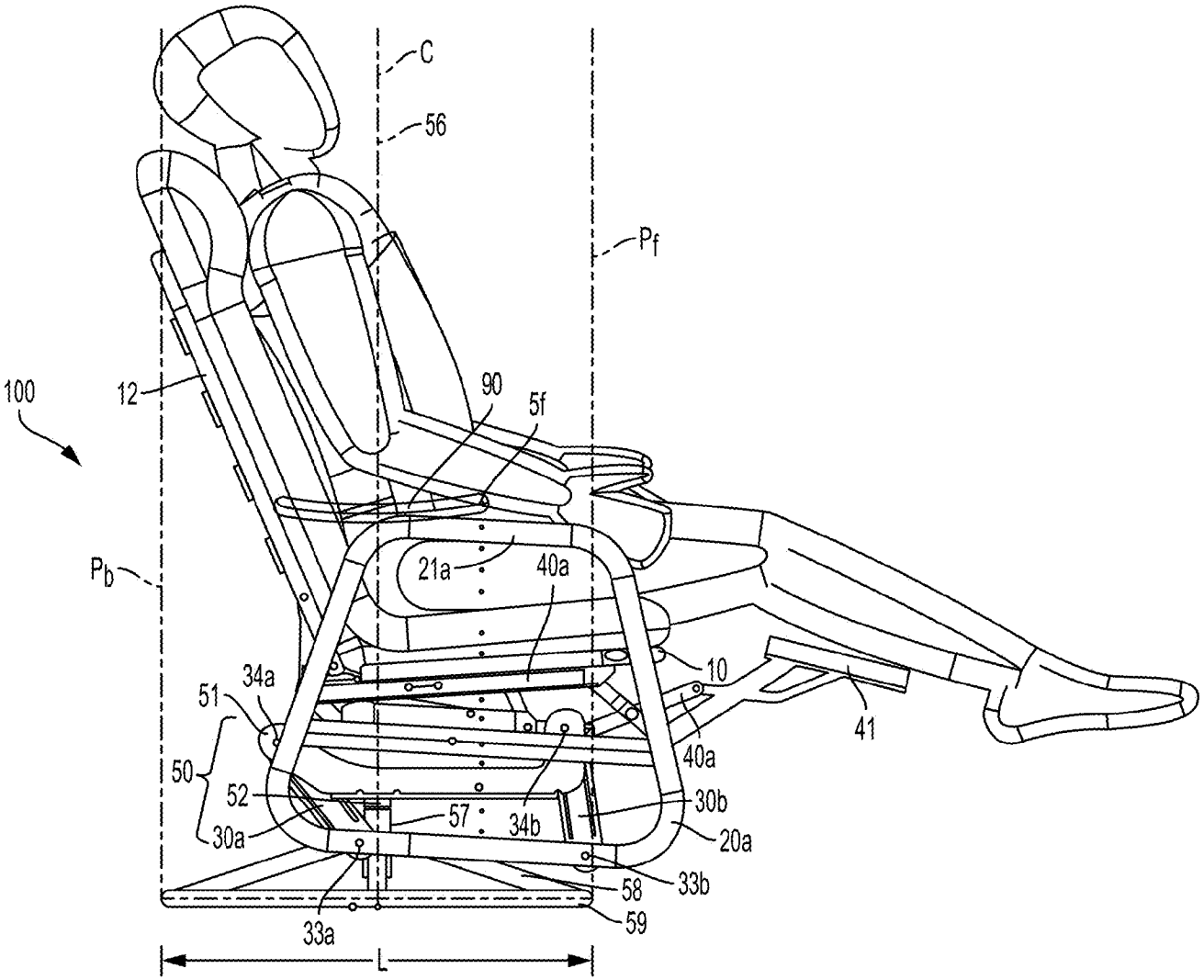
FIGS. 1*a* and 1*b* are left side elevation views of a gliding recliner armchair with backrest and footrest in a fully extended position with a gliding system (a) at a foremost position and (b) at a backmost position, a user sitting on the gliding recliner armchair.

Like numerals represent like features on the various drawings.

Various aspects of the present disclosure generally address one or more of the problems related to the operation of a glider chair. More particularly, aspects of the present disclosure address problems related to the operation of a glider armchair providing backrest reclining and footrest deployment (extension) functions. Operation of the backrest/footrest functionalities of the glider armchair, without preventing gliding motion, is further addressed.

An embodiment of a gliding mechanism for a gliding recliner chair and of a gliding recliner armchair with footrest comprising the gliding mechanism, will now be described in details referring to the appended drawings. However, at least some of the teachings of the present disclosure are applicable to glider chairs without armrest and/or without footrest. The following description of a gliding recliner armchair with footrest is illustrative only and is not intended to limit the applicability of the gliding mechanism to other types of glider chairs.

Referring to FIGS. 7*a*-7*e*, there is illustrated a gliding recliner armchair 100 comprising a seat 10 and backrest 12 assembly mounted on a pair of parallel spaced apart pantographic backrest/footrest actuators 40*a*-40*b* assembled on a cross member 22 extending between and connecting first 20*a* and second 20*b* vertical side frames together to form a seating assembly. The actuators 40*a*-40*b* enable reclining movement of the backrest synchronized with seat displacement with respect to frames 20*a*-20*b* and extension of a footrest plate 41 (see FIGS. 1 to 6). Upper portions 21*a*-21*b* of the frames 20*a*-20*b* can be used as armrests. Alternatively, separate padded armrest members (not shown) can be mounted to the upper portions 21*a*-21*b*, using screws for example. Of course, a glider chair using the present gliding mechanism may be provided without armrests.

Each of side frames 20*a*-20*b* is operatively connected to a floor-standing base 50. Connection of the floor-standing base 50 to the side frames 20*a*-20*b* is made through connecting links 30*a*-30*d*. Bolts or studs 33*a*-33*d* attach the connecting links 30*a*-30*d* to the side frames 20*a*-20*b* and bolts or studs 34*a*-34*b* attach the connecting links 30*a*-30*d* to the floor standing base 50. More specifically, the connecting links 30*b* and 30*d* connect a front portion of the floor-standing base 50 to front portions of the side frames 20*a*-20*b* using bolts or studs 33*b*, 33*d*, 34*b* and 34*d*. Likewise, the connecting links 30*a* and 30*c* connect a back portion of the floor-standing base 50 to back portions of the side frames 20*a*-20*b* using bolts or studs 33*a*, 33*c*, 34*a* and 34*c*. The bolts or studs 33*a*-33*d* and 34*a*-34*d* are configured to allow pivoting of the connecting links 30*a*-30*d*, in order to enable gliding movement of the seating assembly with respect to the floor-standing base 50, as it is known in existing glider armchairs. For example a front pivoting point P1 is formed by bolt or stud 33*b* and a back pivoting point P2 is formed by bolt or stud 34*a*. Front links 30*b* and 30*d* are transversely connected together by a rod 31 and links 30*a* and 30*c* are transversely connected together by a rod 32 to ensure coordinated movement. The floor-standing base 50 comprises a pivoting portion 51 (FIGS. 9*a*-9*d*) assembled on a circular floor-engaging portion 58 for pivotal movement about a vertical axis 56.

Referring more specifically to FIGS. 9*a*-9*d*, the pivoting portion 51 comprises a longitudinal cross member 53 connected at each end to braces 55*a*-55*b* so that the cross member 53 is parallel to a width of the pivoting portion 51 and with a width of the seating assembly. A center post, or pivot 52, is mounted on the cross member 53 for pivotally engaging a bore 57 and bushing (not shown) provided at the center of the floor-engaging portion 58 at the axis 56, which is perpendicular to the plane of a perimeter 59 of the floor-engaging portion 58. The symmetry of the perimeter 59 allows the armchair 100 to recline and glide in any radial orientation of the seating assembly in relation to the floor-engaging portion 58.

In an alternative embodiment of the gliding recliner armchair 100, a circular rotation of the seating assembly about the axis 56 may not be provided. In this alternative embodiment, the pivoting portion 51 is fixedly connected to the floor-engaging portion 58.

Unlike known gliding armchairs, links 30*a*-30*d* are mounted on the inside of the pivoting portion 51 but outside of the pantographic actuators (between the actuators 40*a*-40*b* and the pivoting portion 51). This special feature enables the use of a relatively wider and more comfortable footrest plate 41 extending between the side frames 20*a*-20*b* without interfering with the floor-standing base 50 during gliding when the footrest actuators 40*a*-40*b* are retracted.

At least one stop pin 54 (here, one is provided on each side) is provided to define a backmost position of gliding when links 30*b* and 30*d* abut thereon. Contact of links 30*a*-30*b* with cross member 53 acting as a stop member defines the foremost allowed position of gliding.

Figure 1B:
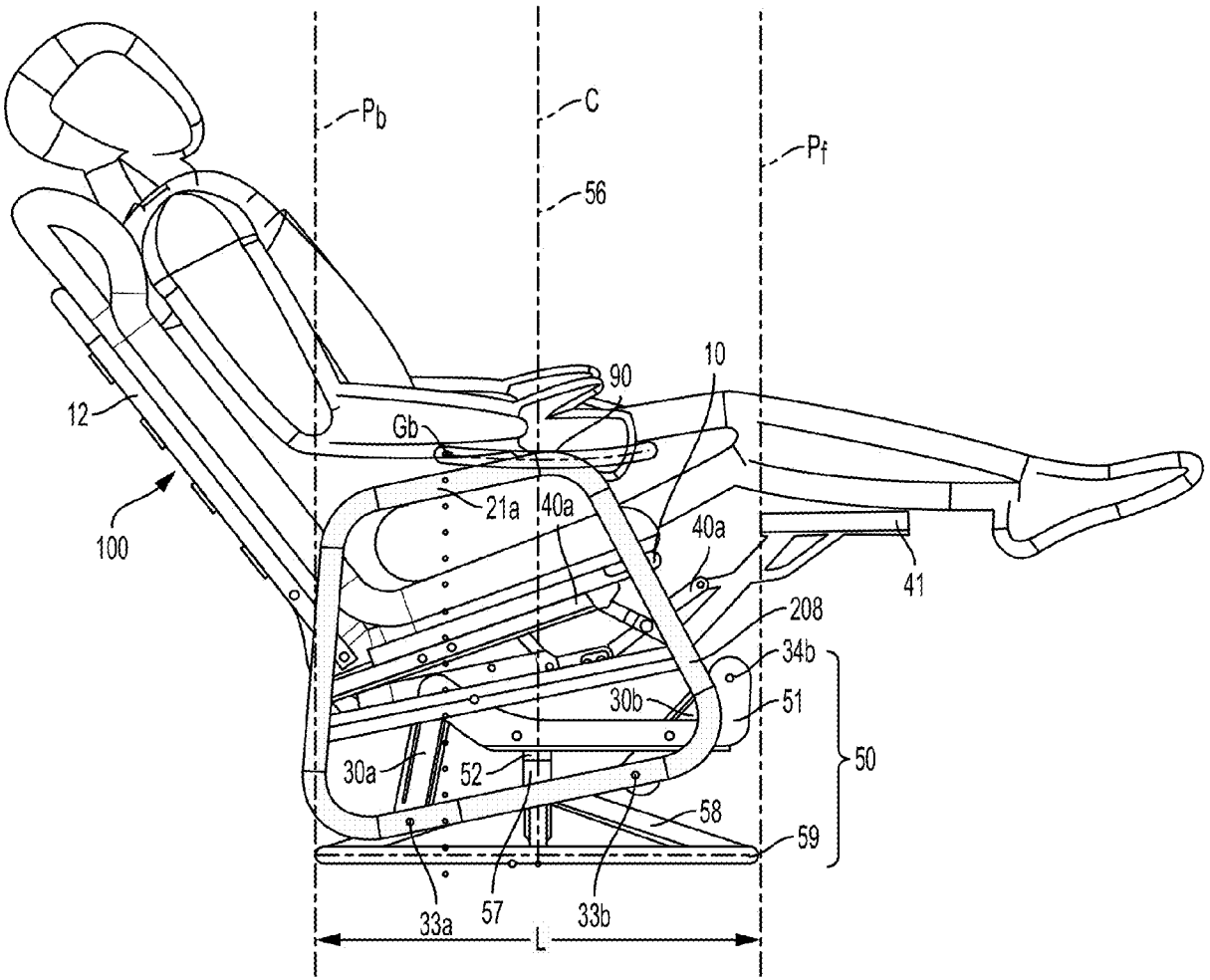

Referring to FIGS. 1*a* and 1*b*, the armchair 100 is shown with a user in a sitting position and with the actuators 40*a*-40*b* extended to provide reclined backrest 12 and deployed footrest 41. A representative user selected for stability studies was 6 foot tall and weighed about 180 pounds. In FIG. 1*a*, the armchair is shown in a foremost position of the gliding movement and in FIG. 1*b* the armchair in shown in a rearmost position of the gliding movement. Vertical phantom lines are provided: Line C showing the center axis of the pivot 52 and bore 57 supporting the pivoting portion 51, line Pb being a normal projection of the backmost end of the perimeter 59 of the floor-engaging portion 58, and line Pf being a normal projection of the foremost end of the perimeter 59.

Figure 2A:
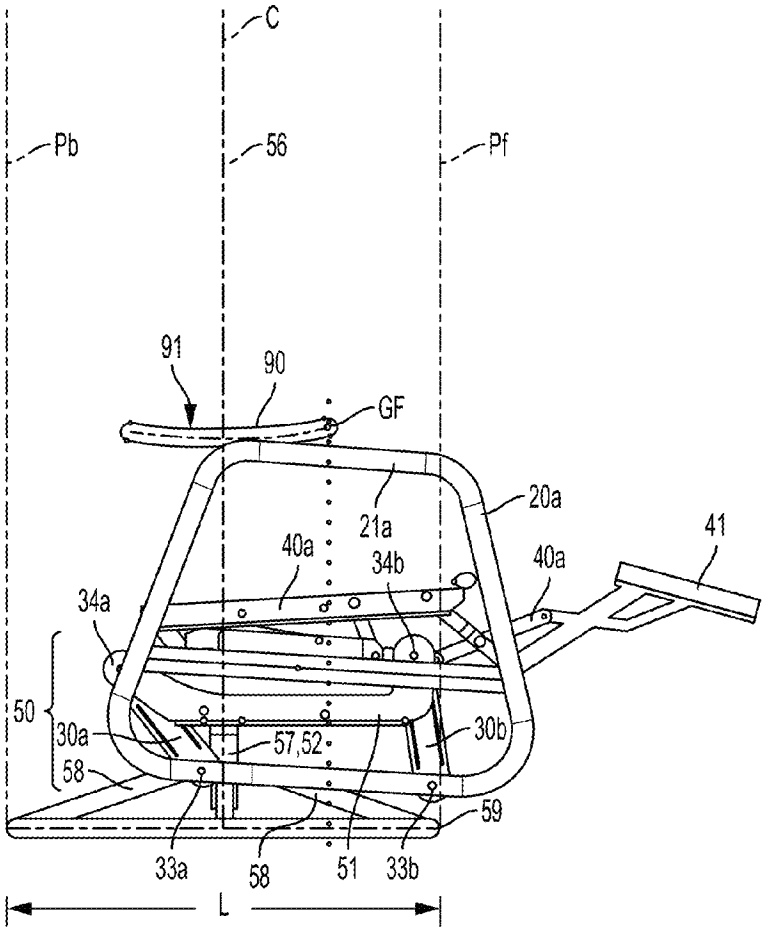
FIGS. 2*a* and 2*b* are partial views of FIGS. 1*a* and 1*b* detailing a path of the center of gravity (chair and user) upon gliding movement between (a) the foremost position and (b) the backmost position.
Figure 2B:
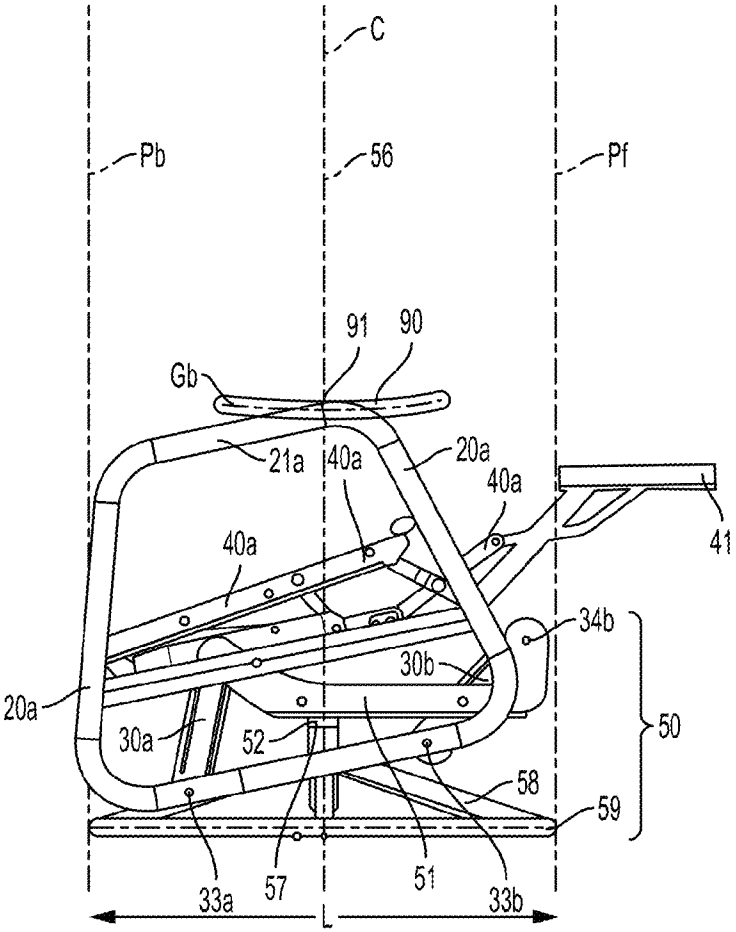

FIGS. 2*a* and 2*b* represent the same respective armchair positions but with a partial view to better show a path 90 followed by the center of gravity during gliding. Gf indicates the instant position of the center of gravity in the position of FIG. 1*a* (foremost) and Gb indicates the instant position of the center of gravity in the position of FIG. 1*b* (backmost).

As can be appreciated, the present design limits displacement of the center of gravity of the present gliding recliner armchair in the most extreme conditions, i.e. reclined backrest 12 and deployed footrest 41. A center 91 of the path 90 followed by the center of gravity is substantially normal to the vertical axis 56 of the floor-standing base 50. By reducing the displacement of the center of gravity along the path 90 in proximity with the vertical axis 56 of the floor-standing base 50, it is possible to provide a gliding recliner armchair with a reclinable backrest, and deployed footrest, which can be safely glided in its fully open position. FIGS. 2*a* and 2*b* further show that at any particular gliding position, the projection of the combined center of gravity along an axis normal to the plane of the perimeter 59 always falls within the perimeter delimited by lines Pf and Pb. Moreover, one may observe that the projections of Gf and Gb in these critical positions are still away from Pf or Pb by a ratio of about ⅓ of a dimension L corresponding to the base perimeter (substantially equal to the diameter of floor-engaging portion 58). Given the symmetry of the floor-engaging portion 58, this holds true for any angular position of the armchair about the central axis C. A ratio higher than about 20% has been found by experience to provide sufficient stability.

Therefore, it can be seen that the cross member 53 supporting the upper portion of the armchair 100 on the floor-engaging portion 58 is not centered between the front and back pivoting points (for example P1 and P2 on FIG. 9*d*) of links 30 on the pivoting portion 51 but is rather strategically positioned rearward to enable a stable and safe behavior of gliding movement in reclined and footrest extended position with respect to the center of gravity.

Figure 9A:
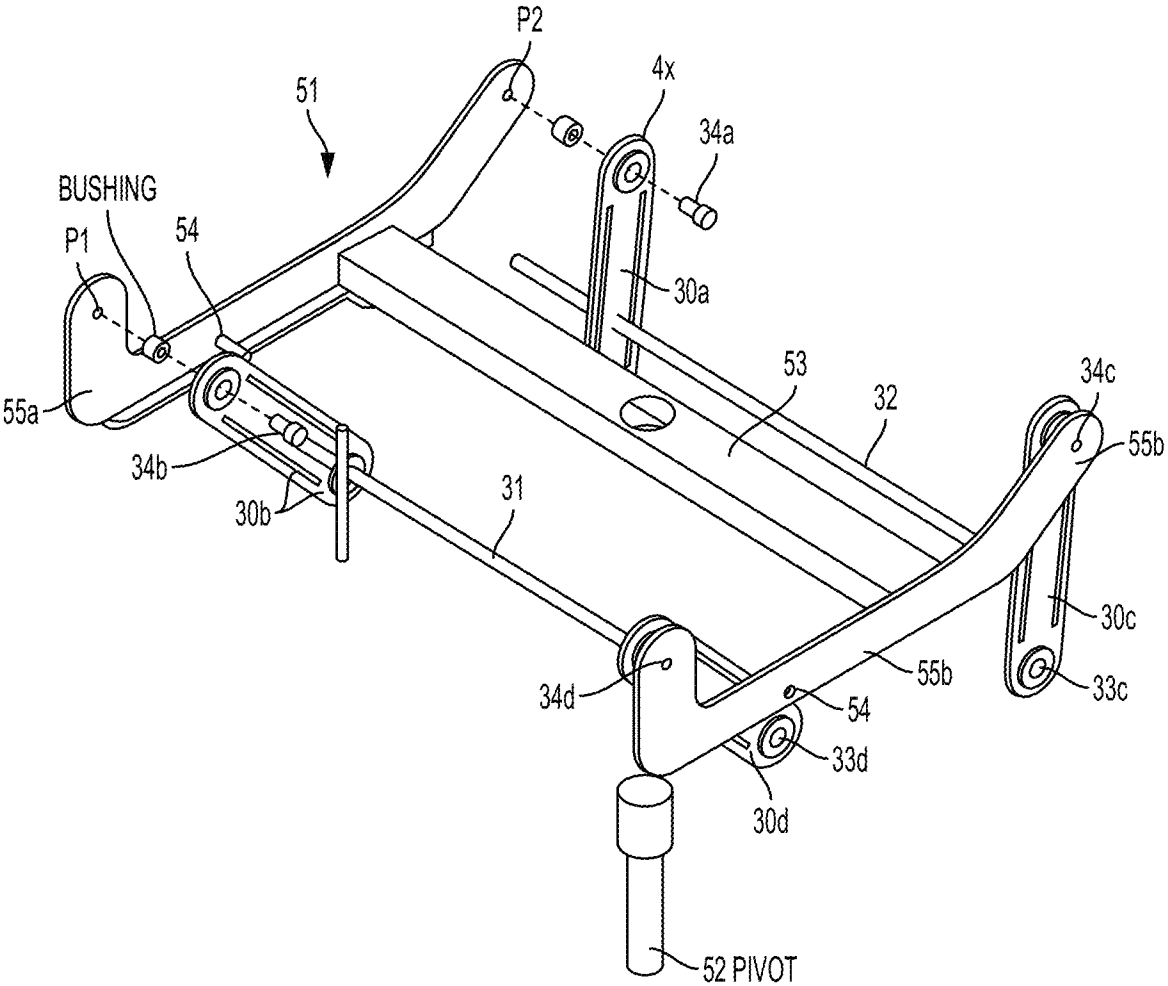
FIGS. 9*a* to 9*d* show various views of a pivoting portion according to the gliding recliner armchair of FIGS. 1*a* and 1*b*: (a) top side isometric view, (b) top view, (c) front elevation view and (d) cross-sectional view of the left side as viewed from line A-A of FIG. 9*c*.
Figure 9B:
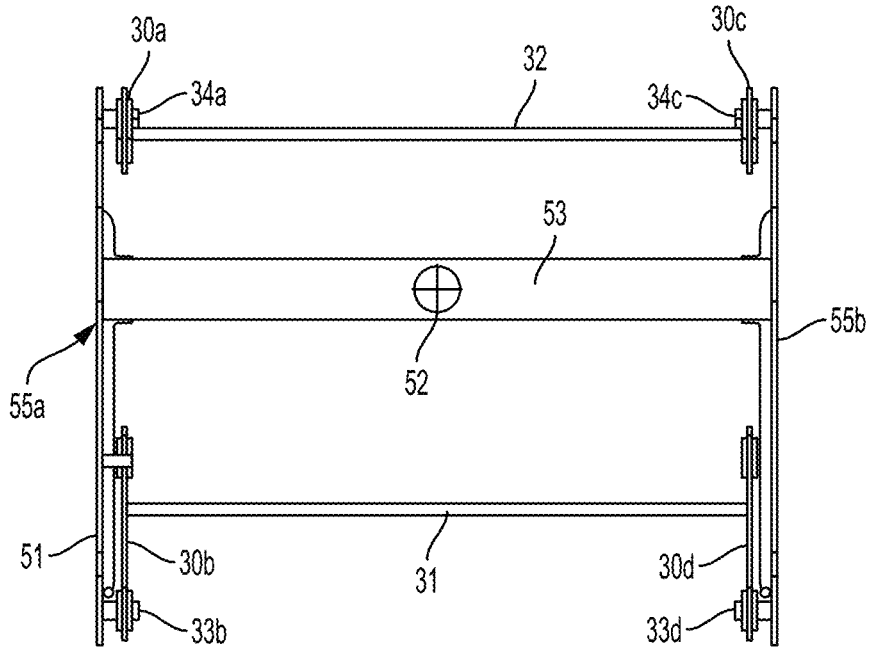
Figure 9C:
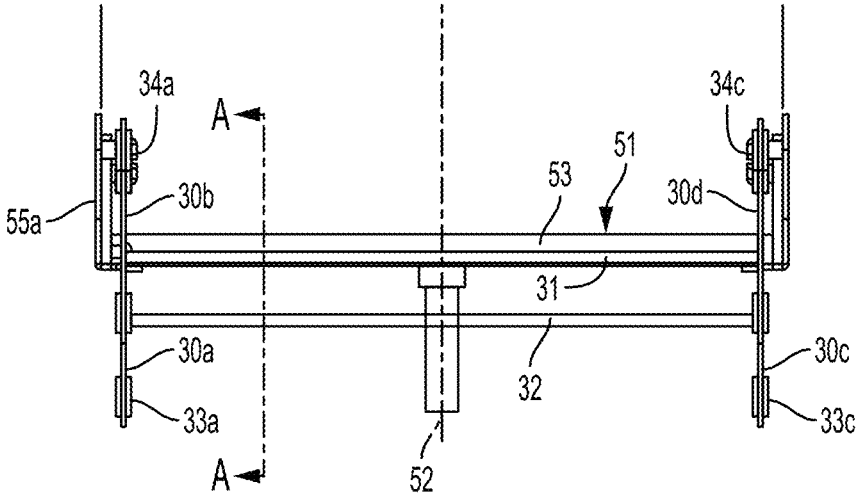
Figure 9D:
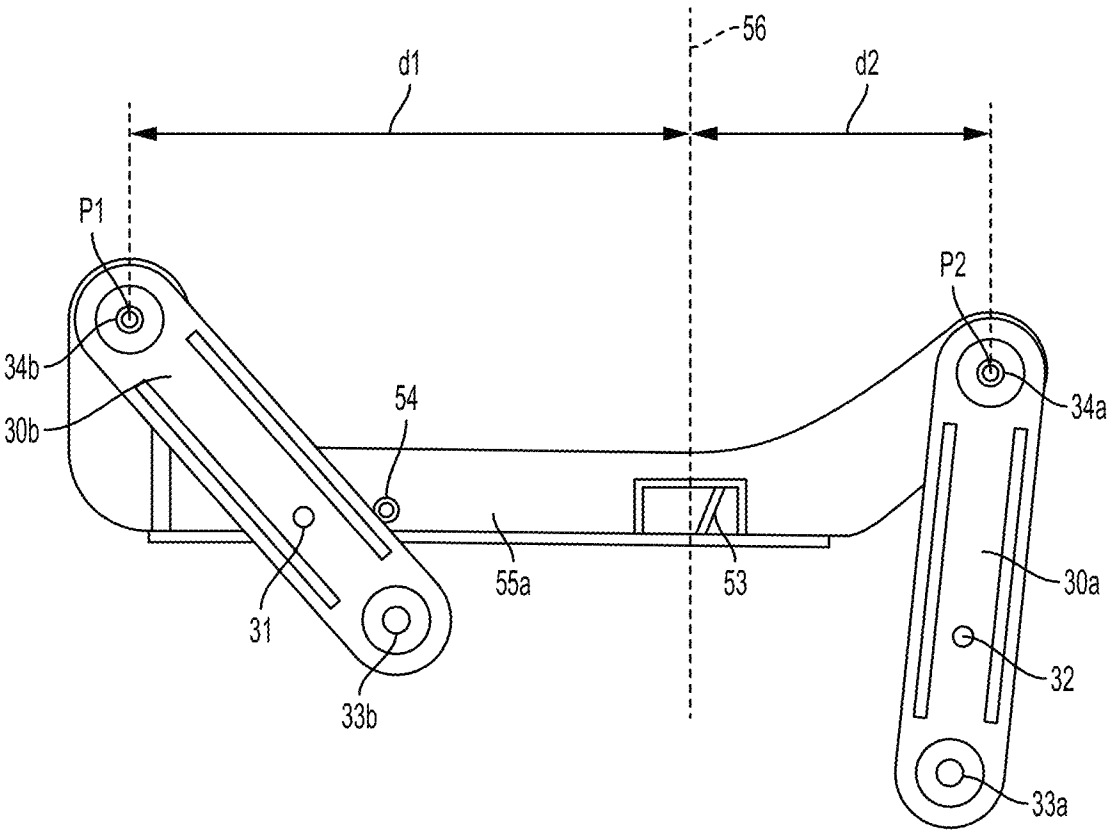

On FIG. 9*d*, a horizontal distance d1 between the front pivoting point P1 and the vertical axis 56 is about 1.85 times a horizontal distance d2 between the vertical axis 56 and the back pivoting point P2. This relation between values of d1 and d2 is illustrative and non-limiting. Some variations of a ratio of d1 over d2 are contemplated. For example d1 can be greater than d2 by a factor in a range between about 1.6 and 2.

In one practical and non-limiting realization, the floor-engaging portion 58 has a base perimeter L equal to 26 inches while the seat 10 has a depth of 20 inches. On FIG. 7*a*, which shows the gliding recliner armchair unloaded (without user) with the backrest and footrest in fully retracted position, a front edge of the seat 10 extends beyond the diameter of the floor-engaging portion 58 by about one (1) inch and a rear edge of the seat 10 lies within the diameter of the floor-engaging portion 58 by about seven (7) inches. Consequently, the seat 10 is centered longitudinally about four (4) inches forward in relation to the vertical axis 56.

Workable values of the ratio of d1 over d2, the sizes of the floor-engaging portion 58 and of the seat 10, and relative positions of the seat 10 and of the floor-engaging portion 58 are expected to vary according to selected dimensions of various components of the gliding mechanism and of the gliding recliner seating assembly, and according to the intended use of the gliding mechanism and of the gliding recliner seating assembly.

Figure 3A:
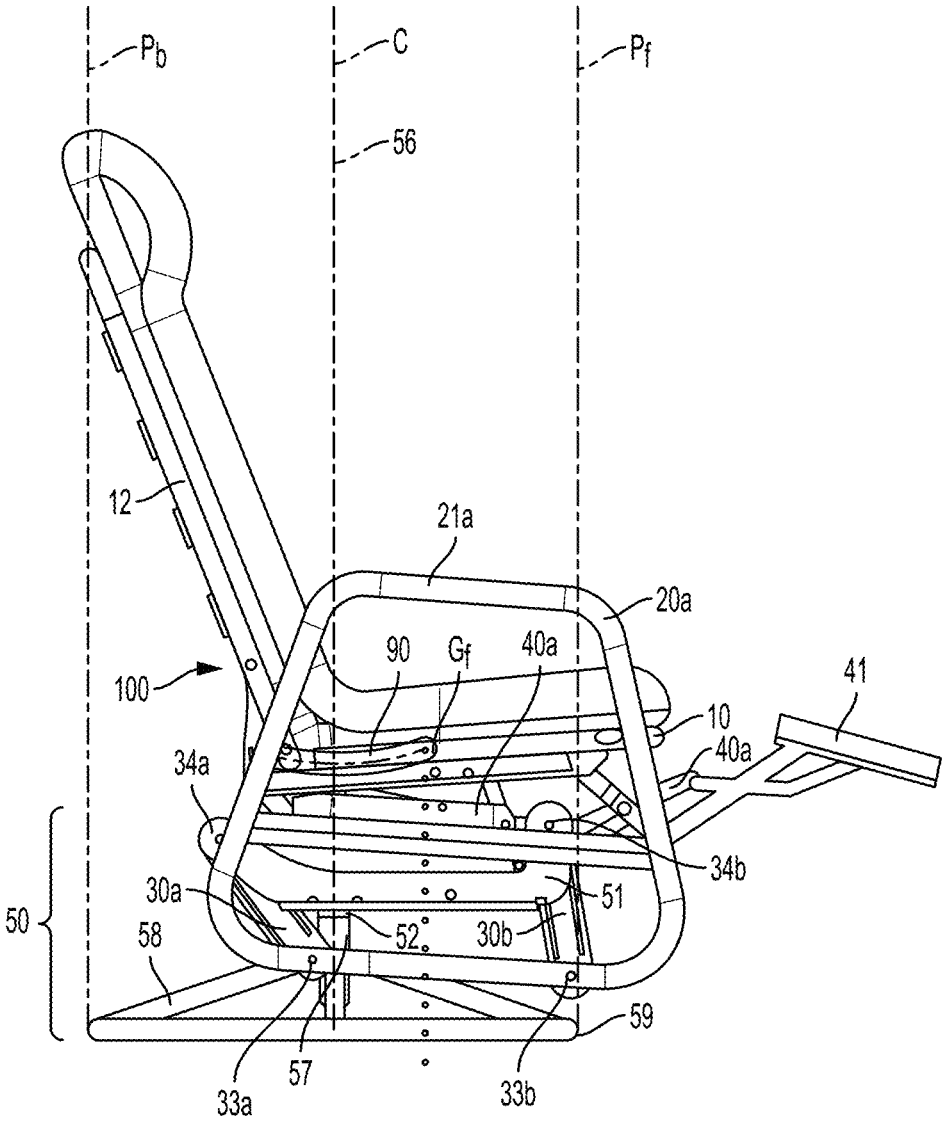
FIGS. 3*a* and 3*b* are left side elevation views of the gliding recliner armchair of FIGS. 1*a* and 1*b* with backrest and footrest in a fully extended position and the gliding system (a) at the foremost position and (b) at the backmost position, with no user sitting.
Figure 3B:
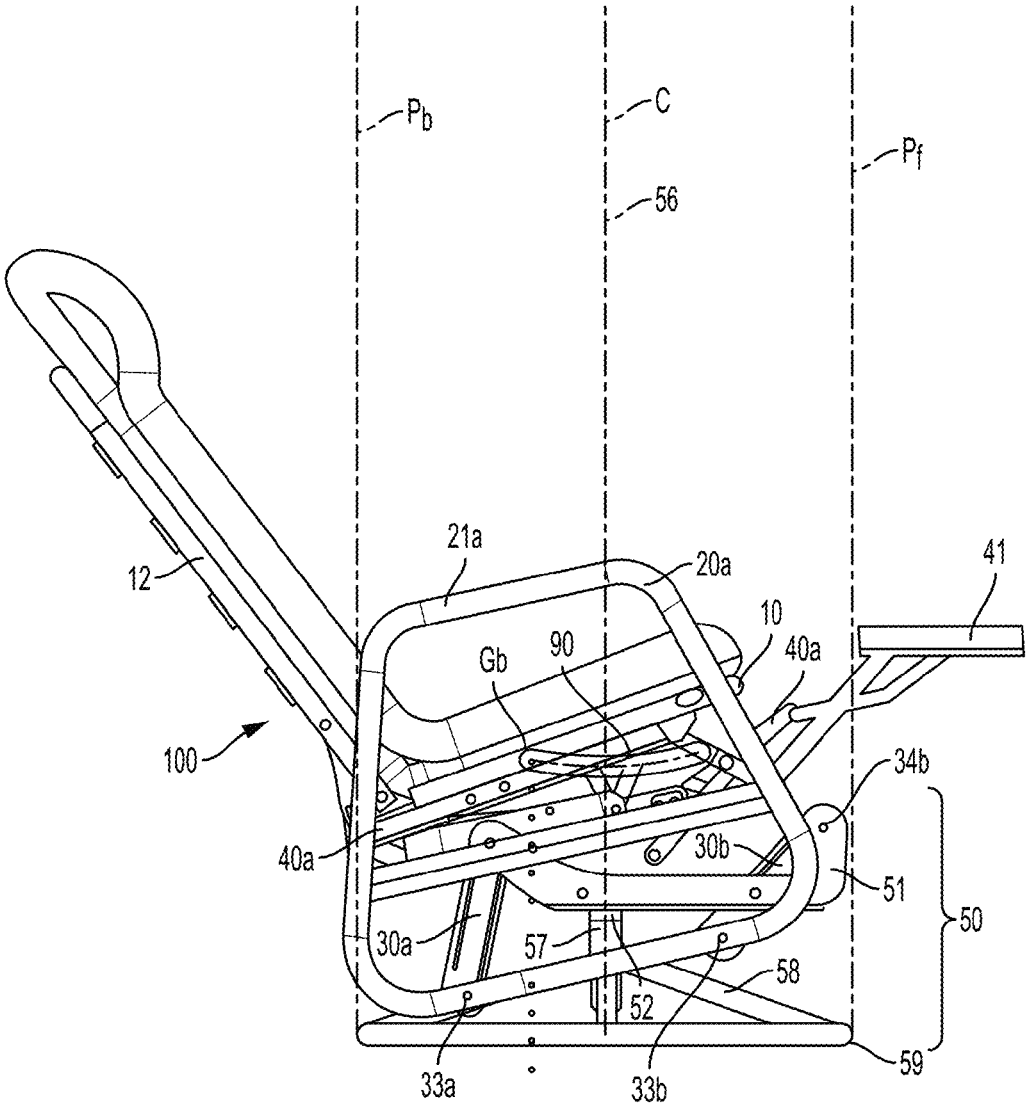
Figure 4A:
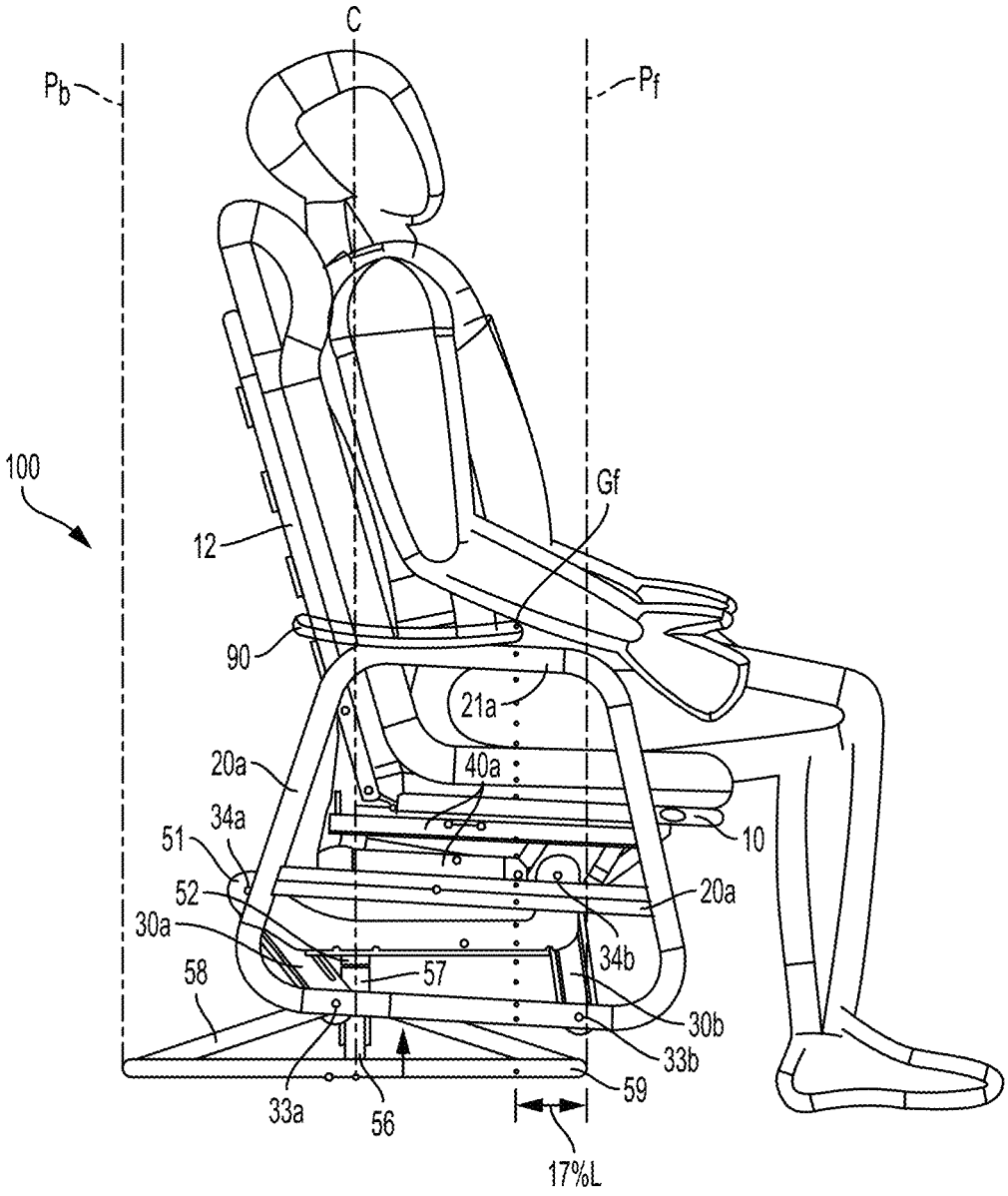
FIGS. 4*a* and 4*b* are left side elevation views of the gliding recliner armchair of FIGS. 1*a* and 1*b* with backrest and footrest in a fully retracted position and the gliding system (a) at the foremost position and (b) at the backmost position, with a user sitting.
Figure 4B:
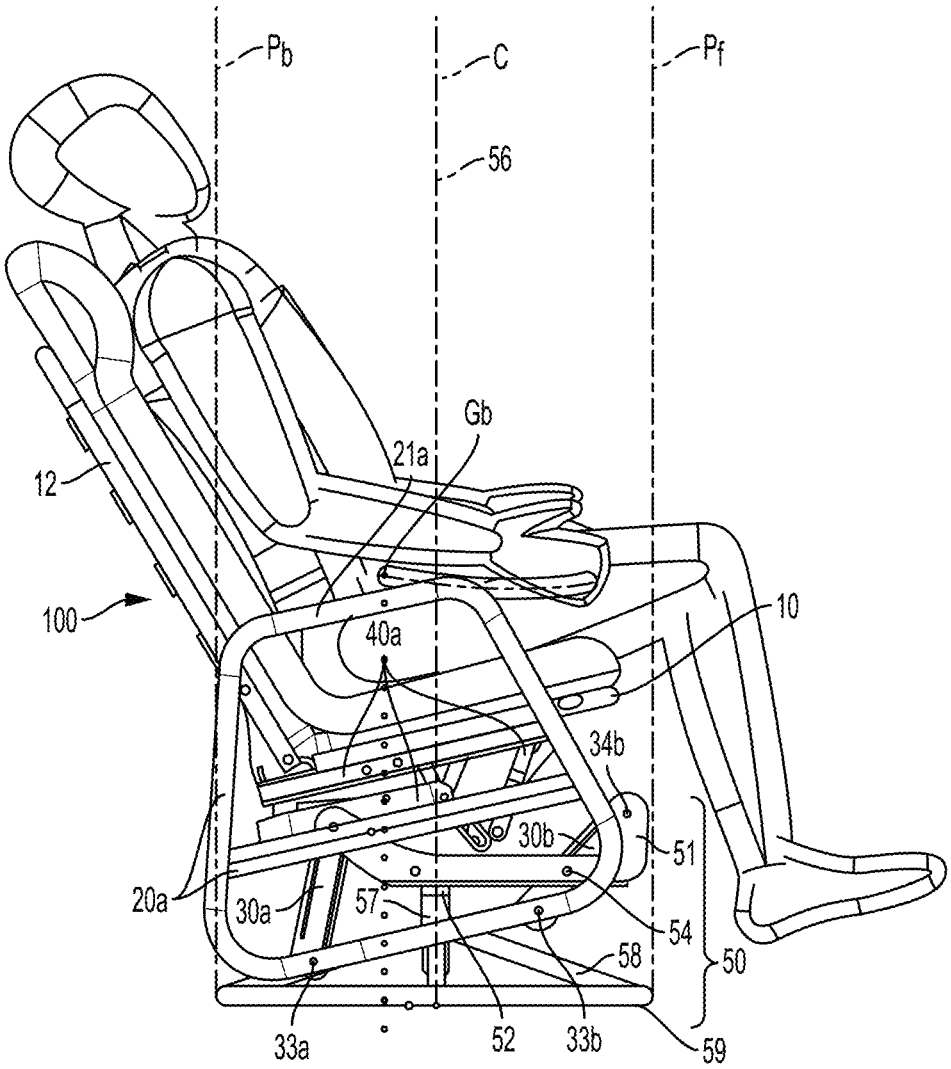
Figure 5A:
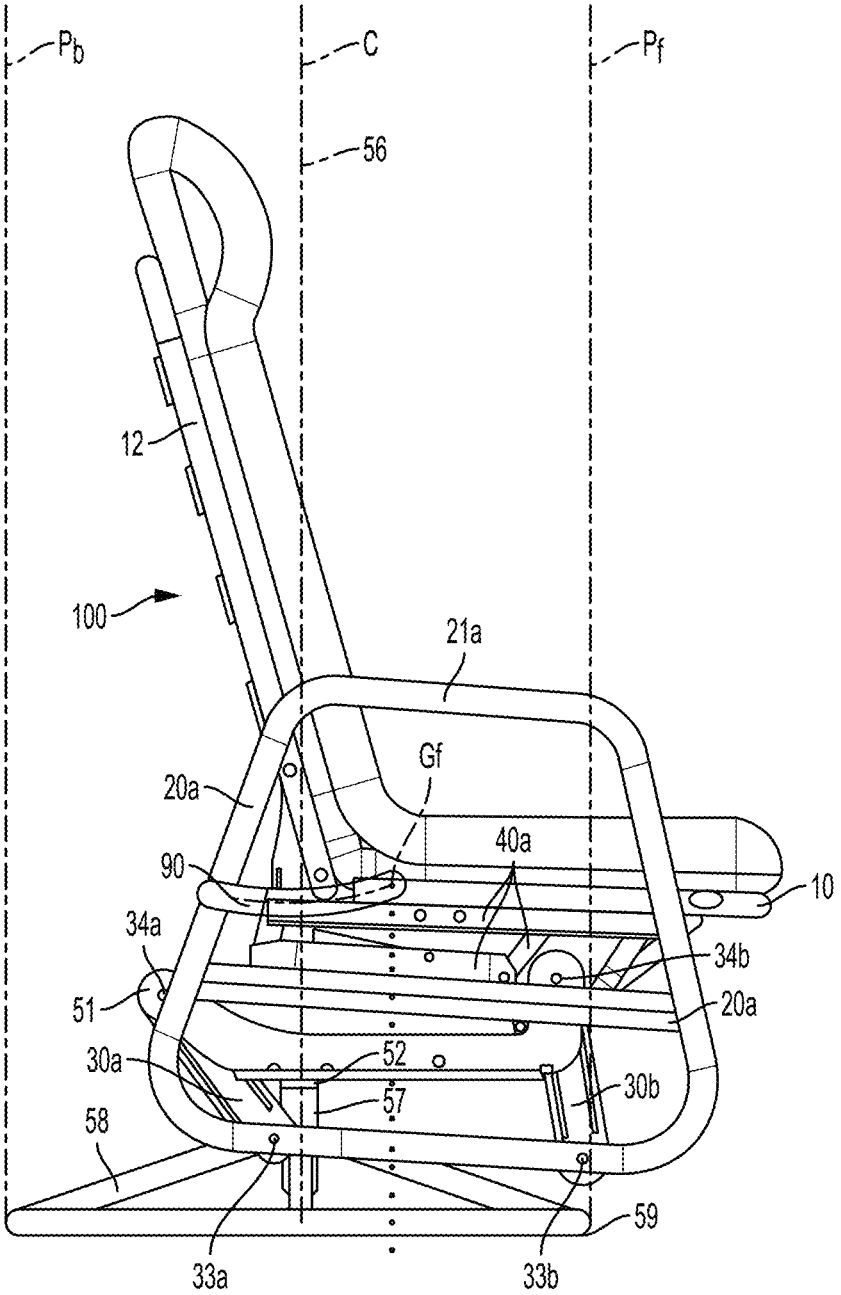
FIGS. 5*a* and 5*b* are left side elevation views of the gliding recliner armchair of FIGS. 1*a* and 1*b* with backrest and footrest in a fully retracted position and the gliding system (a) at the foremost position and (b) at the backmost position, with no user sitting.
Figure 5B:
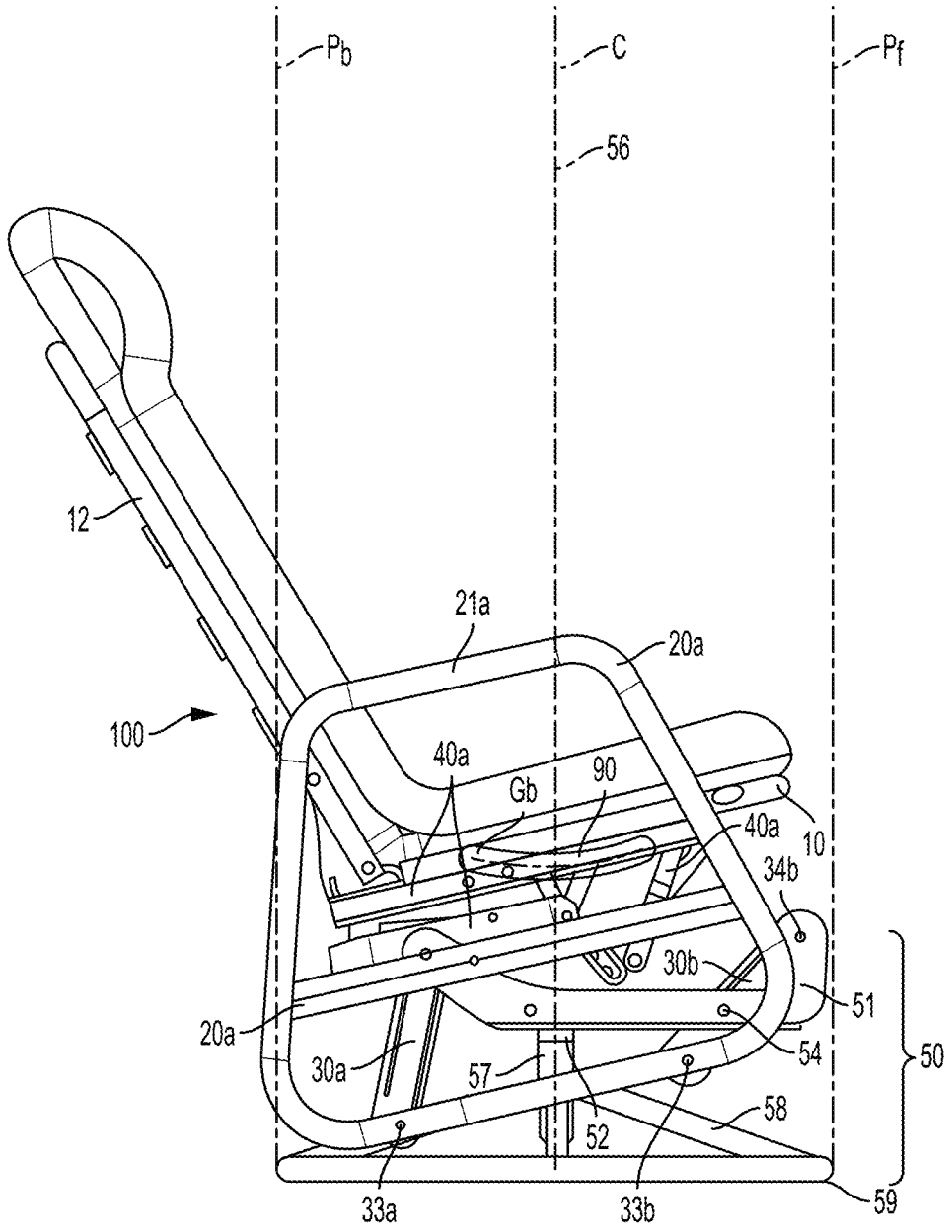

FIGS. 3*a* and 3*b* show the gliding recliner armchair with only the footrest extended in respectively the most frontward and rearward positions. As depicted, at the most frontward and rearward gliding positions, the center of gravity of the armchair with the footrest extended remains within slightly less extremes and safer limits than the displacement represented in FIGS. 2*a*-2*b* previously discussed. The reduced movement of the gravity center indicates that the presence of a user has minimal influence on the stability in this situation, and that geometric properties and material selection of the armchair 100 would hold safe operation for a very wide range of anthropometric characteristics. Steel or any material with similar solidity characteristics is selected for adequate rigidity of the armchair structure and for proper balancing. Of course, this does not apply to cushioning, to seat and backrest suspension or to cosmetic make up.

FIGS. 4*a*-4*b* and 5*a*-5*b* show that stability is also kept within a similar safety range when the footrest 41 and backrest 12 are set in the retracted position, with or without a user sitting. Actually, the most critical position a user may experience is with the footrest 41 retracted when reaching the foremost gliding position. Still, in the stability studies for the 6 foot tall, 180 pounds representative user, the projection of Gf in FIG. 4*a* remained inside the perimeter 59 and away from line Pf by about 17% of L, as illustrated on FIG. 4*a*. This situation is considered acceptable by experience considering that forward tilting of the armchair doesn't occur without excessive forward projection of the user's body and the user may easily put his feet on the floor and stand up from the sitting position. It is envisioned that any projection of Gf at least 15% away from line Pf provides safe operation of the gliding recliner. Therefore, the built-in safety factor is higher for the extended position and backmost gliding attitude since backward tilting theoretically presents a higher risk of injury.

Figure 6A:
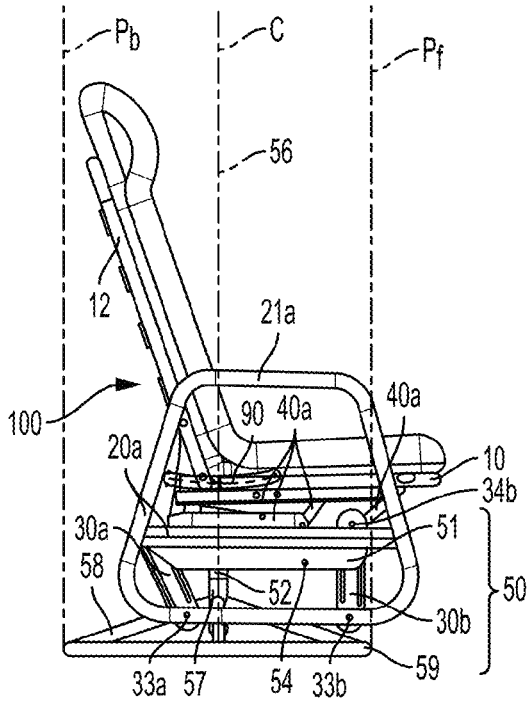
FIGS. 6*a* and 6*b* are left side elevation views of the gliding recliner armchair of FIGS. 1*a* and 1*b* alone in a normal rest position, with backrest and footrest in (a) a fully retracted position and (b) a fully extended position.
Figure 6B:
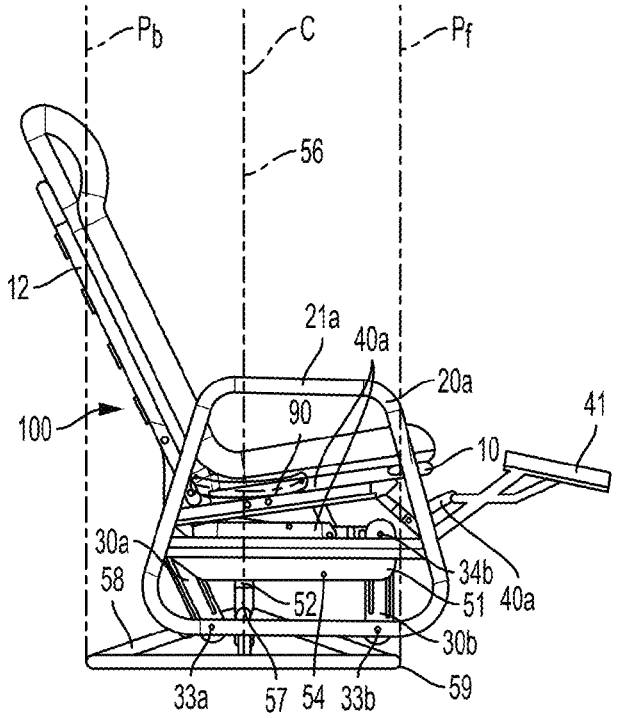
Figure 7B:
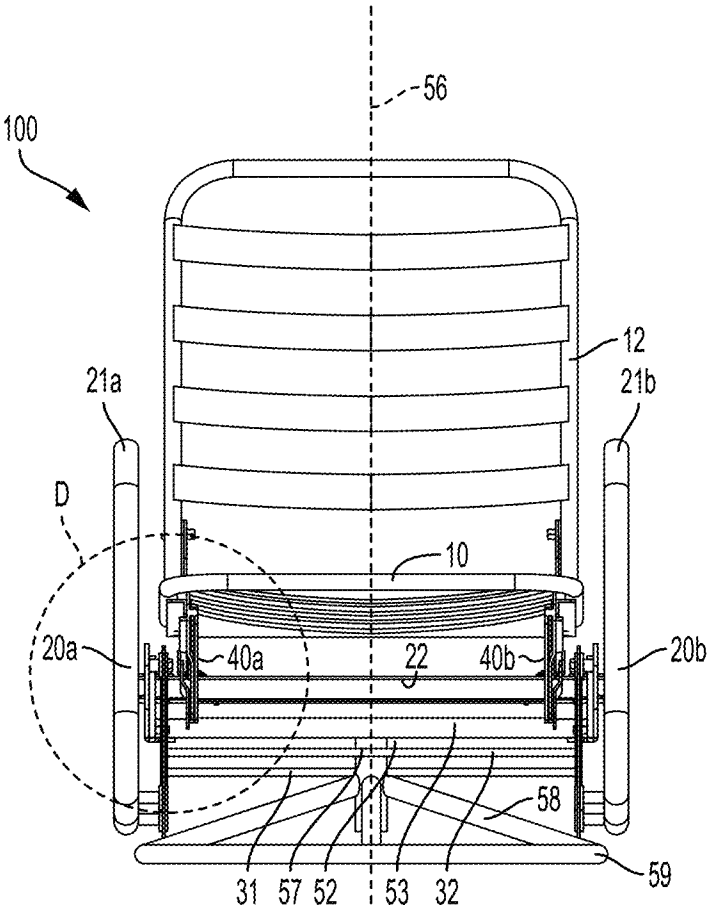
Figure 7A:
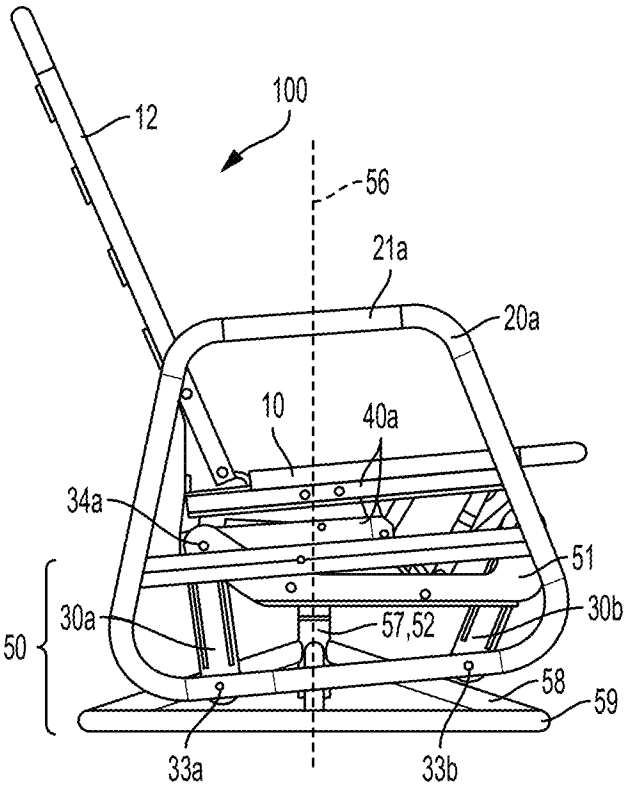
Figure 8A:
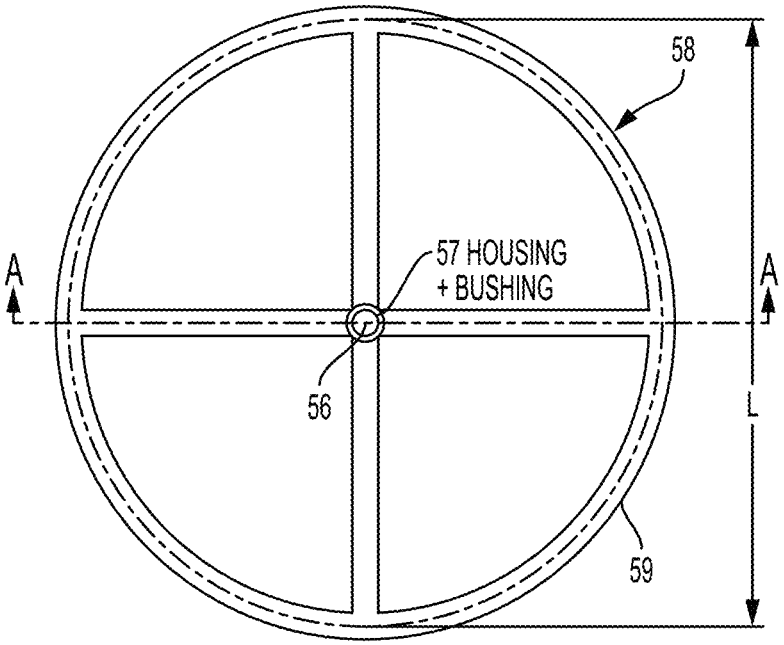
FIGS. 8*a* and 8*b* respectively show a top view and a cross-sectional elevation view of a floor-engaging portion of the gliding recliner armchair of FIGS. 1*a* and 1*b*.
Figure 8B:
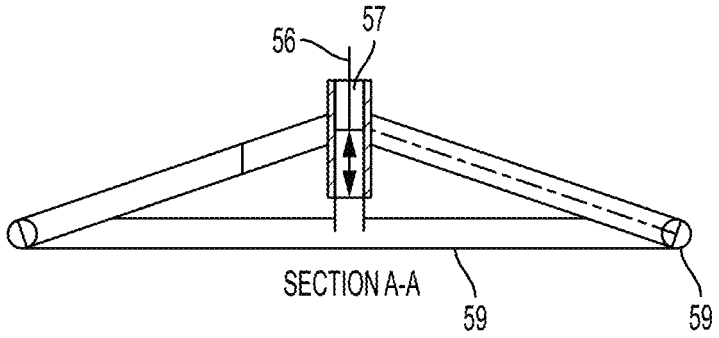

The difference between the resting position of the armchair 100, with backrest 12 and footrest 41 in (a) a fully retracted position and (b) a fully extended position is shown at FIGS. 6*a* and 6*b*. It can be seen that the reclining actuators 40*a*-40*b* do not change the relative angle between the seat 10 and the backrest 12, but cause this seat 10 and backrest 12 assembly to slide and tilt in the backward direction. A user may perform the displacement from retracted position to reclined position, simply by urging his back against the backrest while pushing forward on the frames 20*a*-20*b* and unfolding his legs. At rest, in either position, the center of gravity is very close to the center axis C of the pivot 52 and naturally slightly forward in the reclined position.

One may therefore appreciate that the afore described embodiment of the gliding recliner armchair with footrest provides a safe, reliable and cost effective way of enabling gliding and backrest reclining/footrest deployment operable simultaneously in a same piece of furniture. Therefore, it can be seen that the armchair according to the present disclosure overcomes the limitations, drawbacks and shortcomings of existing gliding recliners.

Although the present gliding mechanism has been described hereinabove by way of non-restrictive, illustrative embodiments thereof, these embodiments may be modified at will within the scope of the appended claims without departing from the spirit and nature of the present disclosure.

What is claimed is:

1. A gliding mechanism for mounting to a gliding recliner seating assembly, the gliding mechanism comprising:

a floor-standing base comprising a floor-engaging portion defining a planar perimeter having a longitudinal dimension configured for placement in a direction of a gliding movement of the seating assembly and having a longitudinal cross member configured for placement in parallel to a width of the seating assembly, the longitudinal cross member being configured for supporting a weight transferred by the seating assembly to the floor-standing base when the gliding mechanism is mounted to the seating assembly, the weight transferred by the seating assembly to the floor-standing base comprising a weight of the seating assembly alone or a combined weight of the seating assembly and of a user sitting on the seating assembly; and two front connecting links and two back connecting links configured for, respectively, pivotally connecting front and back portions of the seating assembly to the floor-standing base so that the longitudinal cross member is positioned closer to the back portion of the seating assembly than to the front portion of the seating assembly when the gliding mechanism is mounted to the seating assembly;

wherein a normal projection of a center of gravity of the weight supported by the longitudinal cross member lies within the planar perimeter, generally spaced from the planar perimeter by a distance of at least about 15% of the longitudinal dimension at any position of the gliding movement.

2. The gliding mechanism of claim 1, wherein the planar perimeter is circular and the longitudinal dimension is equal to a diameter of the planar perimeter.

3. The gliding mechanism of claim 1, further comprising:

a front rod for transversely connecting together the two front connecting links, for coordinating a movement of the two front connecting links; and a back rod for transversely connecting together the two back connecting links, for coordinating a movement of the two back connecting links.

4. The gliding mechanism of claim 1, wherein a position of the longitudinal cross member allows a stable and safe behavior of the gliding recliner seating assembly when the gliding mechanism is mounted to the seating assembly.

5. The gliding mechanism of claim 1, wherein the floor-standing base and the connecting links are made of steel.

6. The gliding mechanism of claim 1, wherein the floor-standing base further comprises a pivoting portion supporting the front and back connecting links, the pivoting portion comprising the longitudinal cross member, the longitudinal cross member being connected to the floor-engaging portion by a pivot allowing a circular rotation about a vertical axis of the pivoting portion with respect to the floor-engaging portion, the vertical axis being aligned with a center of the planar perimeter.

7. The gliding mechanism of claim 6, wherein the front and back connecting links are configured to respectively connect a front of the pivoting portion to the front portion of the seating assembly and a back of the pivoting portion to the back portion of the seating assembly when the gliding mechanism is mounted to the seating assembly.

8. The gliding mechanism of claim 6, wherein the longitudinal cross member is perpendicular to a plane defined by a left front connecting link and a left back connecting link, and perpendicular to a plane defined by a right front connecting link and a right back connecting link, the pivot being disposed on a center of the longitudinal cross member.

9. A gliding recliner chair comprising:

a seating assembly comprising:

a backrest;

left and right vertical side frames; and a seat extending between the left and right vertical side frames; and a gliding mechanism comprising:

a floor-standing base having a longitudinal cross member parallel to a width of the seating assembly, the longitudinal cross member supporting a weight transferred by the seating assembly to the floor-standing base; and two front connecting links and two back connecting links for, respectively, pivotally connecting front and back portions of the seating assembly to the floor-standing base so that the longitudinal cross member is positioned closer to the back portion of the seating assembly than to the front portion of the seating assembly;

wherein the left and right vertical side frames are pivotally connected to the floor-standing base through the front and back connecting links.

10. The gliding recliner chair of claim 9, wherein the chair is an armchair.

11. The gliding recliner chain of claim 9, comprising a footrest operable between a retracted position and an extended position, wherein gliding movement of the seating assembly with respect to the floor-standing base is enabled when the footrest adopts any of the retracted position or extended position.

12. The gliding recliner chair of claim 11, wherein a position of the longitudinal cross member allows a stable and safe behavior of the gliding recliner chair with any of the retracted position or extended position of the footrest.

13. The gliding recliner chair of claim 12 further comprising two parallel spaced apart pantographic backrest and footrest actuators assembled on a cross member extending between the left and right vertical side frames, the two actuators allowing a reclining movement of the backrest and an extension of the footrest synchronized with a seat displacement with respect to the left and right vertical side frames.

14. The gliding recliner chair of claim 11, wherein:

the floor-standing base comprises a floor-engaging portion defining a floor-engaging planar perimeter having a longitudinal dimension in a direction of a gliding movement of the seating assembly; and a normal projection of a center of gravity of the weight supported by the longitudinal cross member lies within the planar perimeter, generally spaced from the perimeter by a distance of at least about 15% of the longitudinal dimension, at any position of the gliding movement and at any position of the backrest and footrest.

15. The gliding recliner chair of claim 14, wherein a center of a path followed by the center of gravity during a gliding movement with the backrest and footrest in the extended position is substantially in alignment with a vertical axis of the floor-standing base, the vertical axis being aligned with a center of the planar perimeter.

16. The gliding recliner chair of claim 14, wherein the planar perimeter is circular and the longitudinal dimension is equal to a diameter of the perimeter.

17. The gliding recliner chair of claim 14, wherein the floor-standing base further comprises a pivoting portion connected to the floor-engaging portion by a pivot allowing a circular rotation about a vertical axis of the pivoting portion with respect to the floor-engaging portion, the vertical axis being aligned with a center of the planar perimeter, the connecting links being supported by the pivoting portion.

18. The gliding recliner chair of claim 17, wherein the longitudinal cross member is perpendicular to a plane defined by a left front connecting link and a left back connecting link, and perpendicular to a plane defined by a right front connecting link and a right back connecting link, the pivot being disposed on a center of the longitudinal cross member.

19. The gliding recliner chair of claim 17, wherein the front and back connecting links respectively connect a front and a back of the pivoting portion to front and back portions of the left and right vertical side frames.

20. The gliding recliner chair of claim 19 further comprising:

a front rod for transversely connecting together the two front connecting links, for coordinating a movement of the two front connecting links; and a back rod for transversely connecting together the two back connecting links, for coordinating a movement of the two back connecting links.

* * * * *